United States Patent [19]

Kelly

[11] Patent Number: 4,966,304

[45] Date of Patent: Oct. 30, 1990

[54] BILL MONEY CHANGER FOR SLOT MACHINES

[75] Inventor: Edward C. Kelly, Blue Bell, Pa.

[73] Assignee: Lamba-Beta-Epsilon Group, Hatfield, Pa.

[21] Appl. No.: 314,132

[22] Filed: Feb. 23, 1989

[51] Int. Cl.[5] ..... G07D 1/04; G07D 7/00; G07F 17/34

[52] U.S. Cl. ..... 221/6; 221/109; 221/196; 221/197; 194/350

[58] Field of Search ..... 221/6, 10, 90, 103, 221/107, 108, 109, 110, 195, 196, 197, 198, 266, 281; 194/206, 207, 350

[56] References Cited

U.S. PATENT DOCUMENTS 532,526 1/1895 Bryce ..... 221/90
4,331,259 5/1982 Imamura ..... 221/197 X
4,717,044 1/1988 Suzuki et al. ..... 221/195 X

FOREIGN PATENT DOCUMENTS 2181876 4/1987 United Kingdom ..... 194/206
2186412 8/1987 United Kingdom ..... 194/206

*Primary Examiner*—F. J. Bartuska
*Attorney, Agent, or Firm*—Gregory J. Gore

[57] ABSTRACT

A roll coin dispenser is extremely narrow and occupies a vacant space between adjacent slot machines. The dispenser changes paper bills into coinage. Loading and access to all internal components of the changer are through the front of an enclosing cabinet which is unobstructed by adjacent slot machines. A coin storage section of the changer includes a multi-cartridge loading and dispensing mechanism in order to permit fast and accurate reloading of the machine by someone who is physically capable of lifting only small weights.

13 Claims, 7 Drawing Sheets

FIG. 1
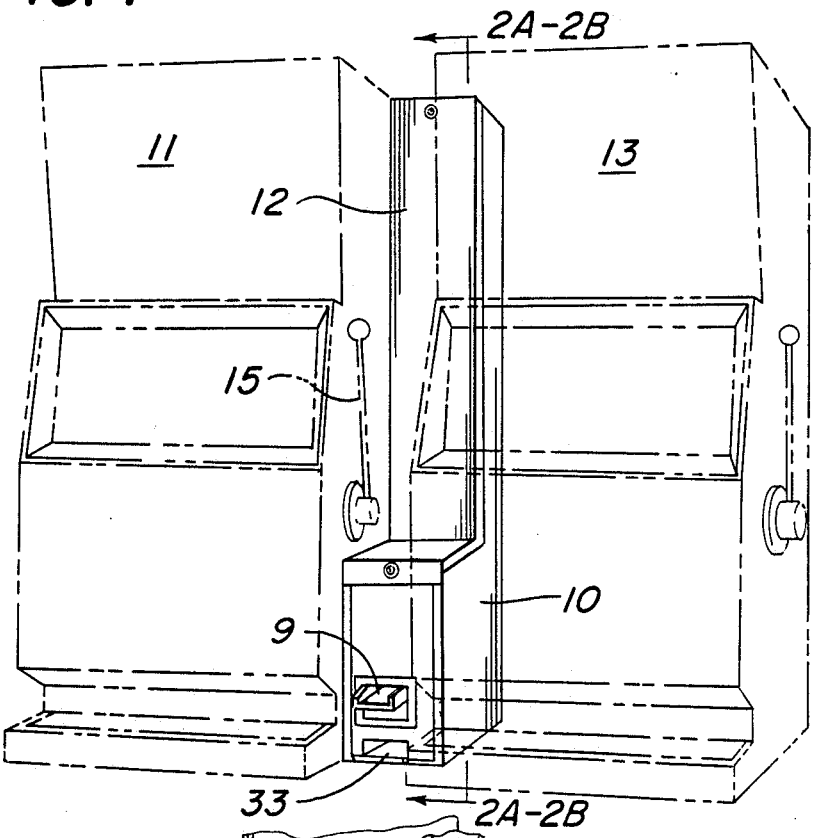
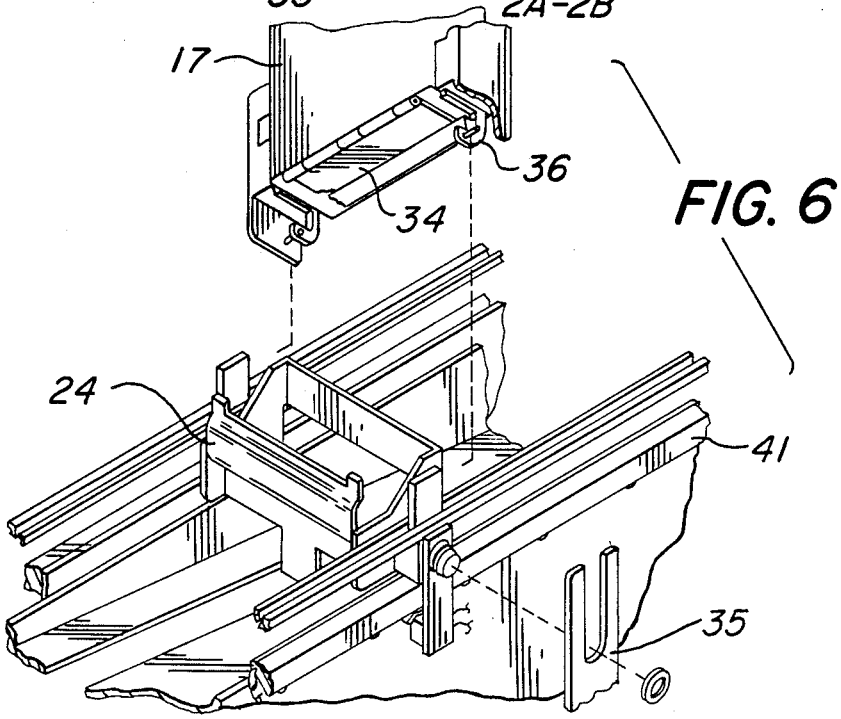
FIG. 6

FIG. 3
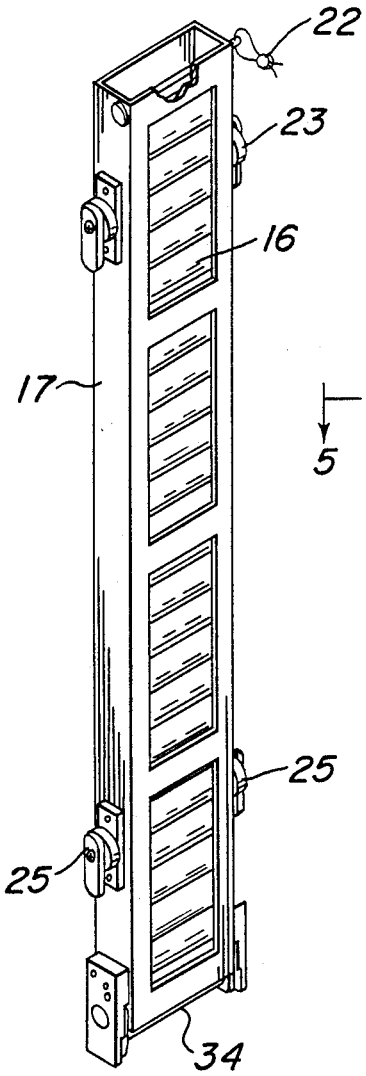
FIG. 4
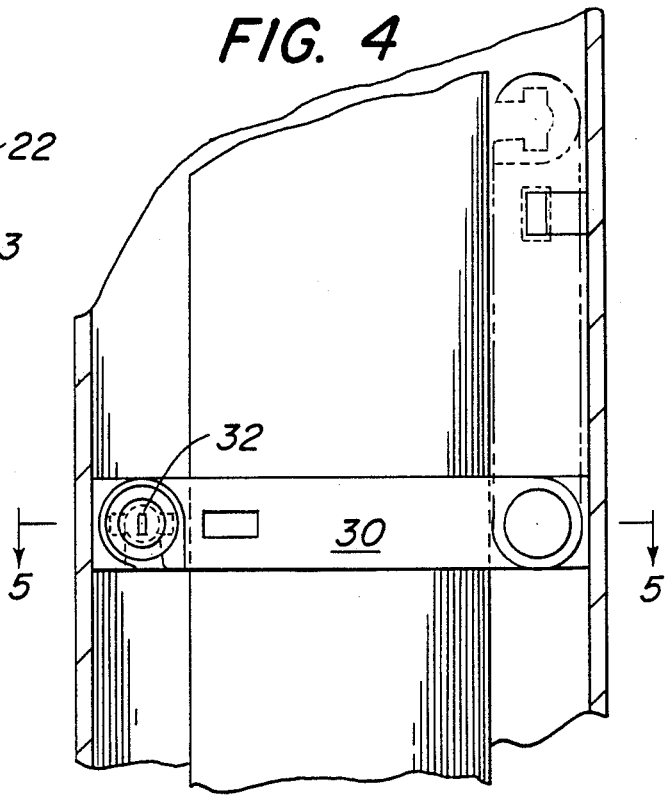
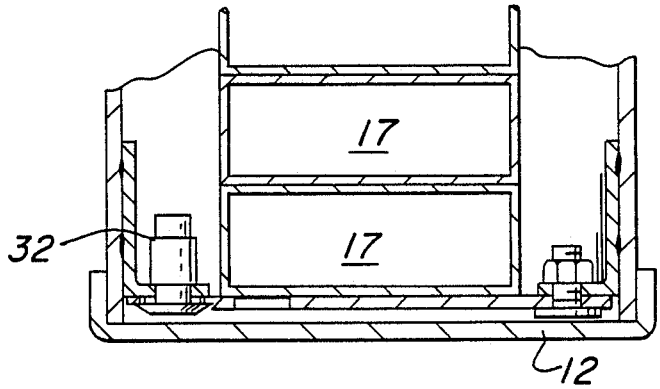
FIG. 5

BILL MONEY CHANGER FOR SLOT MACHINES

FIELD OF THE INVENTION

The present invention broadly relates to dispensing devices and, more particularly, to a coin dispenser for use with gaming devices, such as slot machines.

BACKGROUND OF THE INVENTION

A large portion of the business of gambling casinos is provided by coin-operated machines, such as slot machines. In a single casino, the machines often produce as much as $25,000,000 in annual revenues. This creates a massive need for changing paper money into coin form on or near the gaming floor.

Usually, the first action by a patron entering the gaming facility is to approach a teller to exchange paper money for coinage. Coin change tellers are often found walking throughout the gaming floor or in teller cages in an area adjacent to the coin machines. Almost exclusively, change is given in the form of pre-counted, wrapped coin rolls of fixed denomination which are usually quarters with an equivalent count of $10.00 or 40 quarters to a roll.

This method of change dispensing is extremely labor intensive and inefficient. For example, because of the heavy weight of the coins, there is a limited amount that a walking teller can carry before having to return to a central location for additional coins. For this reason, centralized tellers at coin-dispensing windows are utilized. This, however, poses the problem of inaccessibility to the patrons who must leave the machine they are playing and walk some distance to receive their coins. This is extremely bothersome to the patrons who do not like to leave gaming devices in the middle of a gambling session. As a result, patrons often sit and wait at their machine for a walking teller to provide them change. This creates delay in using the machines which results in a decrease of revenue to the casino and inconvenience to the patrons.

Large bill-changing machines which dispense coins in roll form are used to supplement the centralized coin-dispensing teller. However, these offer no advantages except for a reduction in labor costs. Since space allocation is extremely crucial to casino revenues, every possible amount of floor area is devoted to the gaming machines. Therefore, there is no available floor space near the slot machines for a large roll-coin dispensing machine which would be more convenient for the slot machine players. Furthermore, even though this shortens the walking distance for a patron to receive additional coins, it still does not satisfy patrons who do not want to leave their position at the slot machine. Most gambling regulations prohibit the inclusion of a money-changing device within the gambling machine itself. The regulations require the money changing to be separate from the gambling machine.

There is, therefore, a need for efficient and convenient coin dispensing on the floor of the casino directly adjacent to a slot machine so that patrons may change paper money into coins without waiting or leaving their place. It is also important that no additional floor space be used.

SUMMARY OF THE INVENTION

In order to solve the problems described above, the present roll-coin dispenser has been devised which is located adjacent to a gaming machine, such as a slot machine, but which takes no additional floor space from the gaming area. The present device has been designed to be extremely narrow and to set in the vacant space between adjacent slot machines.

Various features of the device overcome all problems associated with such a compact device located in an otherwise inaccessible place for a bill changer. For example, all loading and access to the internal components of the changer are through the front of its cabinet, as the sides are obstructed by the slot machines. In order to be workable, it is also important that the dispenser hold a sufficient quantity of coins so that overly frequent reloading will not be required. To overcome the problem of loading such a massive weight of coins into the machine, a unique multi-cartridge loading and dispensing mechanism has been devised. The present device permits the fast and accurate reloading of a machine by someone who is physically capable of lifting only small amounts of weight. The cartridge-loading system permits women, often employed as tellers, to be physically capable of the stocking procedure.

The multi-cartridge loading construction is complemented by a sequential dispensing mechanism which accurately and positively shifts from one cartridge to another as each is emptied during operation of the changer.

As it will be more fully described in detail, the present device achieves the following purposes:

1. To provide a roll-coin dispenser for changing paper money into coinage which is separate and apart from a gaming machine in a casino;

2. To locate the money changer adjacent to the gaming machine which will not take up any additional floor space, yet be within reach of the gaming machine operator; and 3. To provide a bill changer which is easily filled with a supply of coins to be dispensed and which requires only minimal physical strength of the stocking person, yet has a capacity for a great amount of coinage so that restocking will not be overly frequent.

Other purposes and advantages will be readily apparent to those of ordinary skill in the mechanical arts from the following drawings and description of the preferred embodiment.

BRIEF DESCRIPTION OF THE DRAWINGS

FIG. 1 is an isometric view showing the outer cabinet and the location of the present device between two adjacent slot machines.

FIG. 3 is a top isometric view of a loaded coin cartridge.

FIG. 4 is a front sectional view taken from FIG. 2A.

FIG. 5 is a top sectional view taken from FIG. 4.

FIG. 6 is a isometric view of the coin cartridge and traveling dispenser shoe.

BRIEF DESCRIPTION OF THE PREFERRED EMBODIMENT

Figure 2A:
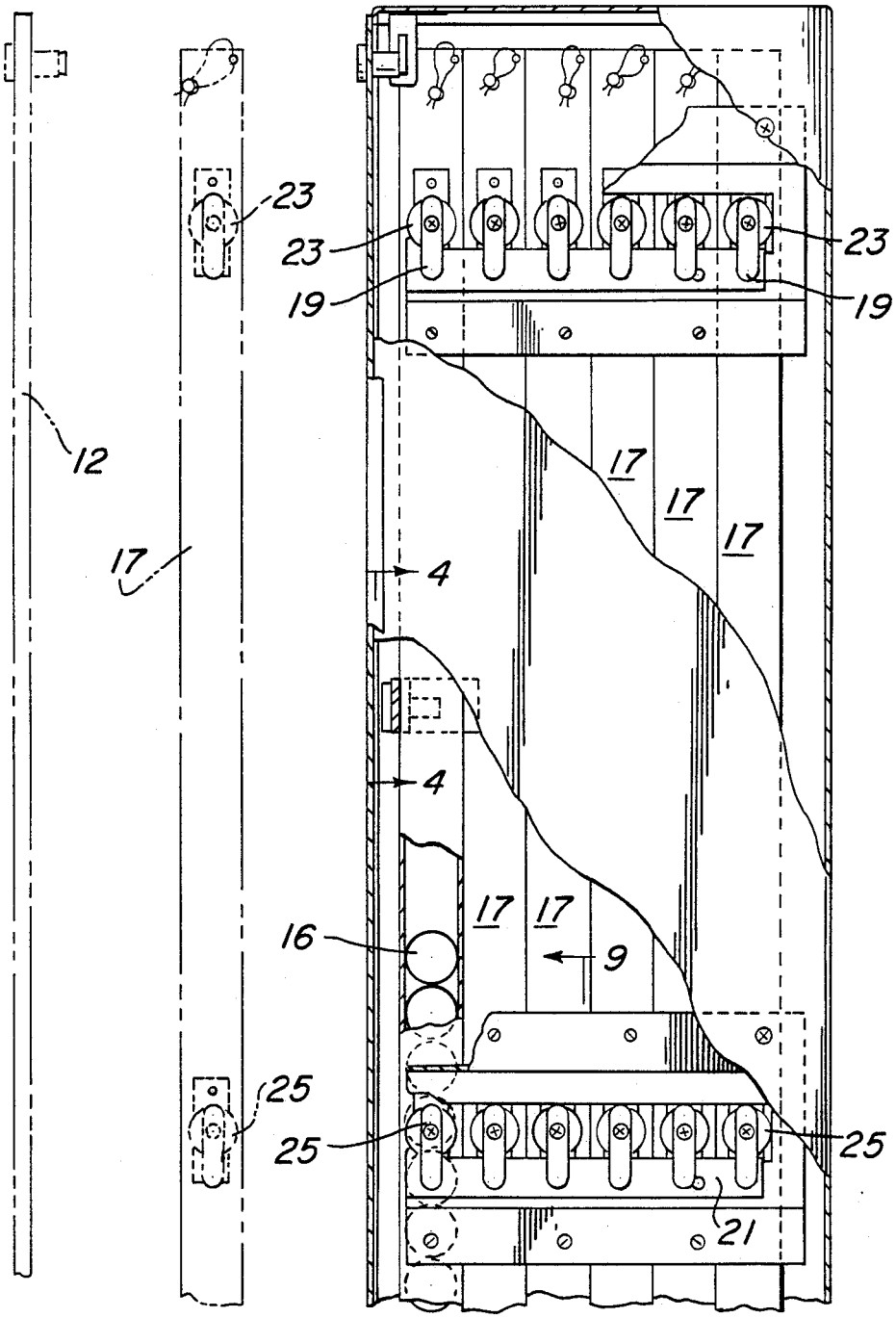
FIG. 2A is a side sectional view taken from FIG. 1 showing the multi-cartridge storage construction. Additional side views of the front panel and coin cartridge are shown in phantom lines.

Referring now to FIG. 1, a top isometric view shows the location of the present coin changing device 10 located between two adjacent slot machines 11 and 13. In the usual arrangement, the slot machines stand on a table which is approximately 36 inches high (not shown). Casino gamblers either sit or stand in front of the slot machines. In order to provide a comfortable space between adjacent players, the slot machines are normally spaced 6 to 8 inches apart. This spacing also provides comfortable access to the actuation lever arm 15 which is located on the side of the slot machine. As shown in FIG. 1, the present device sits on the table between adjacent slot machines and has a front cabinet panel 12 which is set back behind the slot machine lever arm. With this location and construction, the coin dispenser does not impair the use of the slot machines in any way.

The main external features of the present device are an outer cabinet 10, hinged front cabinet panel 12, a bill-acceptance slot 9, and a coin roll dispenser chute 33. The hinged front access panel swings forward to provide access to the coin storage area which is located in the upper part of the cabinet.

Referring now to FIG. 2A, details of the coin roll storage are shown. A plurality of storage cartridges 17, six in all, are shown vertically oriented and in contacting relationship from the front to the back in the changer. Each of the cartridges is suspended from upper and lower siderails 19 and 21 by guide rollers 23 and 25 on each cartridge which ride on the siderails permitting easy front-to-back movement, as well as vertical support of each cartridge. Each cartridge holds a quantity of coin rolls 16.

Figure 2B:
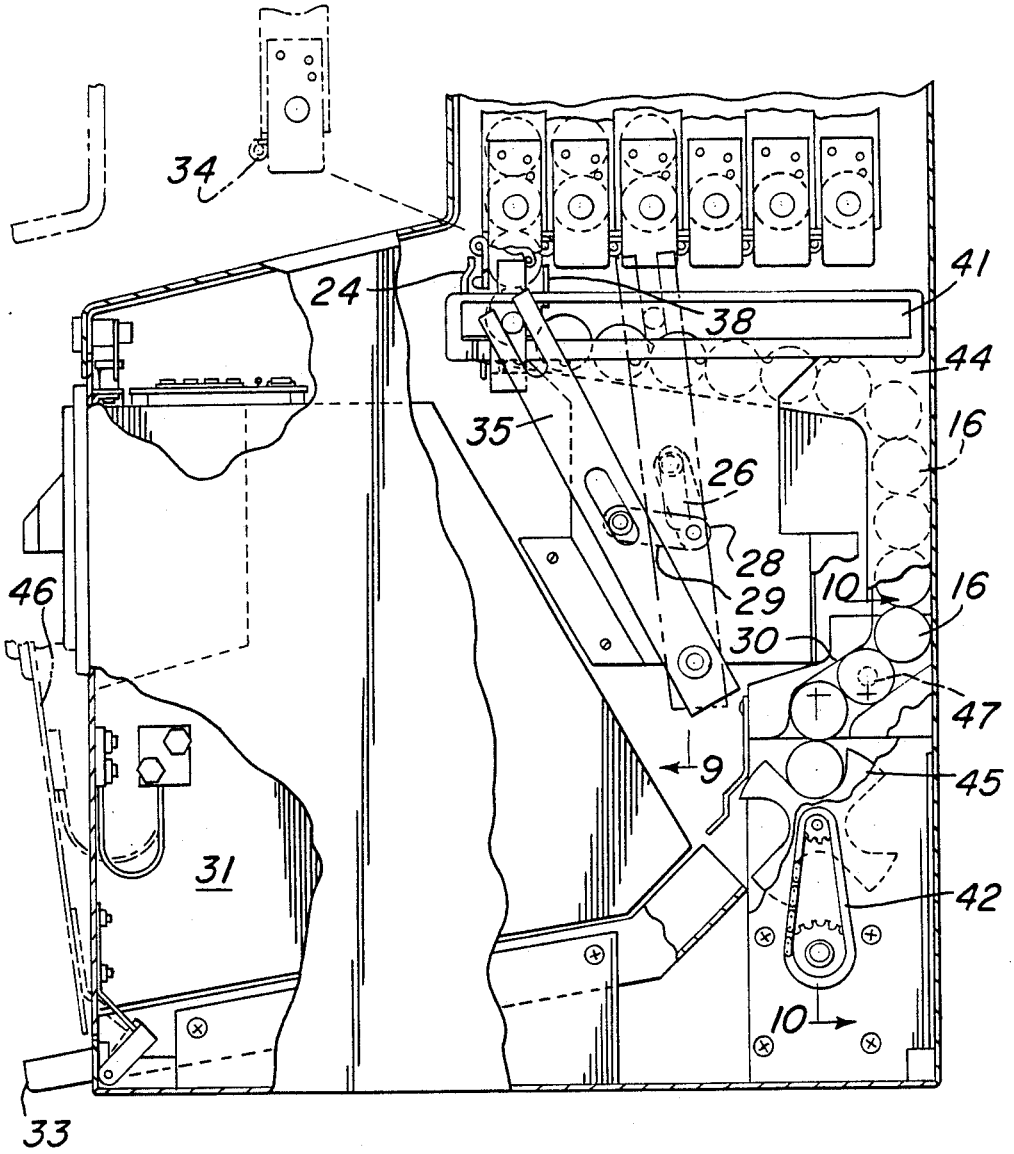
FIG. 2B is a side sectional view taken from FIG. 1 of the lower half of the present device showing the sequential dispensing system.

Referring now to FIG. 2B, a side sectional view of the lower part of the coin dispenser is shown. The electronic bill-validating device 26 is of the type well-known in the electronic arts, such as supplied by Mars Electronics of West Chester, Pa., under the model designation L-020. Front access door 46 permits the unloading of accepted bills which are stored in bin 31. Dispenser chute 33 terminates at the front bottom of the machine.

FIG. 2B shows further details of the sequential coin roll dispensing system. Alignment arms 35 (one on each side) move a traveling dispenser shoe 24 from beneath each storage cartridge as they are emptied. The alignment arm is moved into the next position by sensing and motive means well-known in the mechanical arts. In this preferred embodiment, rotating lever arm 29 is motor driven and controls the movement of forked alignment arms 35. As the alignment arms move the dispenser shoe 24 to the next position below a full cartridge, a trip lever 38 located on the dispenser shoe trips the gate mechanism 34 at the base of the next cartridge. By gravity, the column of coin rolls drops down into the feed chute 44 to provide a continuous supply of coin rolls to the dispensing mechanism. As each cartridge is emptied, the alignment arms move the shoe along slotted guide 41 between successive positions. A counter in the dispenser signals when the shoe is to be moved to its next location.

As further shown in FIG. 2B, a continuous supply of coin rolls is delivered to pin wheel dispenser 45. As each paper bill is accepted, a mechanism is signalled which rotates the pin wheel 90 degrees, which in turn dispenses a single roll of coins. The pin wheel dispenser drive mechanism is of a type well-known to those in the electro/mechanical arts. Sensor 47 is located along the path of the feed chute upstream of the pin wheel dispenser mechanism to indicate when only two coin rolls are left in the machine. Upon sensing this condition, an external signal light affixed to the outside of the cabinet is actuated to indicate that re-stocking of the changer is necessary.

Referring now to FIG. 3, a coin storage cartridge is shown fully loaded and secured against tampering by seal 22. In this embodiment, each cartridge holds approximately 25 rolls of quarters or a total monetary value of $250.00. Thus, the six-cartridge machine shown in this embodiment holds a total of $1,500.00 in quarters. Referring now to FIGS. 4 and 5, the front of the storage area includes a safety bar 30 with a key-release mechanism 32 for securing the storage cartridges.

FIG. 6 shows details of the gate mechanism 34 at the bottom of a storage cartridge and the traveling dispenser shoe which moves beneath the cartridges sequentially as they are emptied. As described previously, the shoe is moved from the front toward the back of the machine by alignment arm 35 shown more clearly in FIG. 2B.

Figure 7:
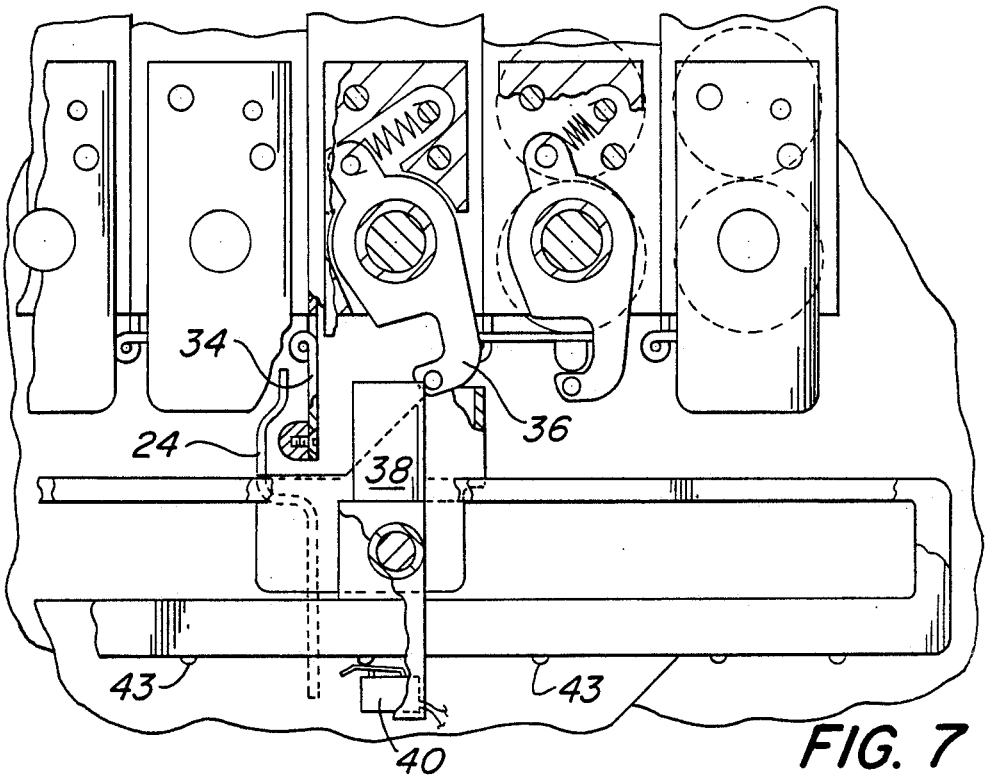
FIG. 7 is a multiple side cutaway view showing details of the coin cartridge gate release mechanism.
Figure 8:
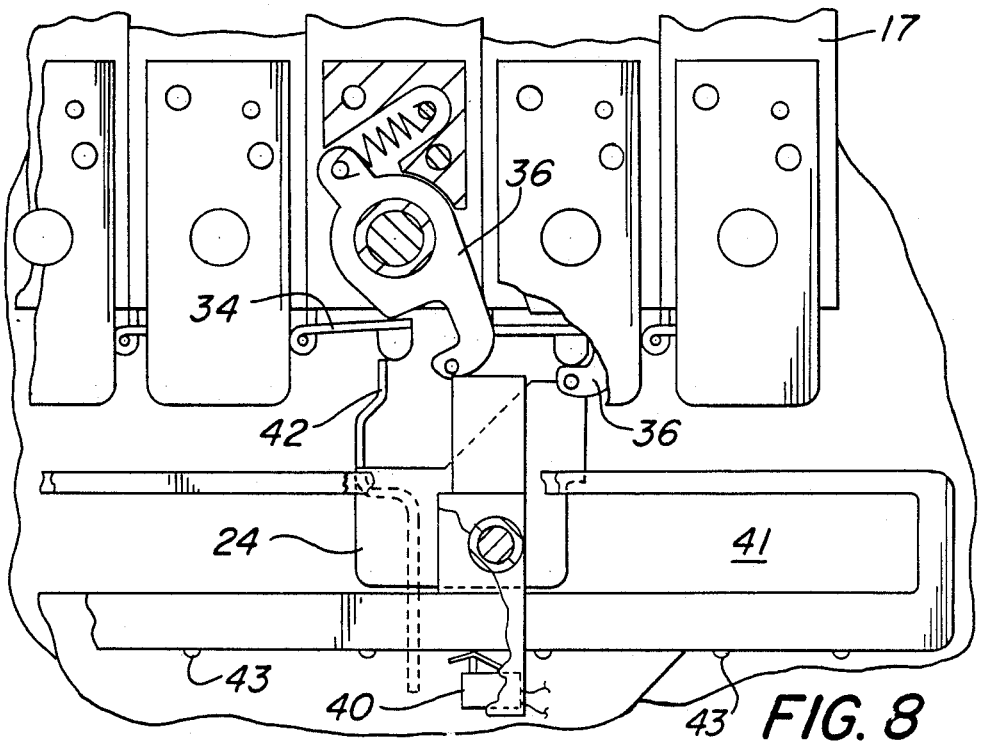
FIG. 8 is a multiple side sectional view showing the sequential advancement of the dispenser shoe.

Referring now to FIG. 7, each storage cartridge includes a hinged gate 34 and a resiliently biased catch 36 to secure the gate in a closed position. The dispenser shoe includes trip lever 38 which releases the gate. The gate drops down by the force of gravity to dispense the column of rolled coins into the feed chute through the center of the dispenser shoe. Switch means 40 is activated by projections 43 beneath each cartridge to identify the location of the dispenser shoe when it is properly located beneath the next cartridge. FIG. 8 shows the dispenser shoe moved to a position of advancement with regard to FIG. 7. The rear wall of the shoe is shown lifting the gate 34 up and releasing the catch 36 so that, once emptied, the cartridge returns to its closed position. In this way, each cartridge is opened, emptied and then closed as the shoe travels from front to back beneath each of the storage cartridges.

Figure 9:
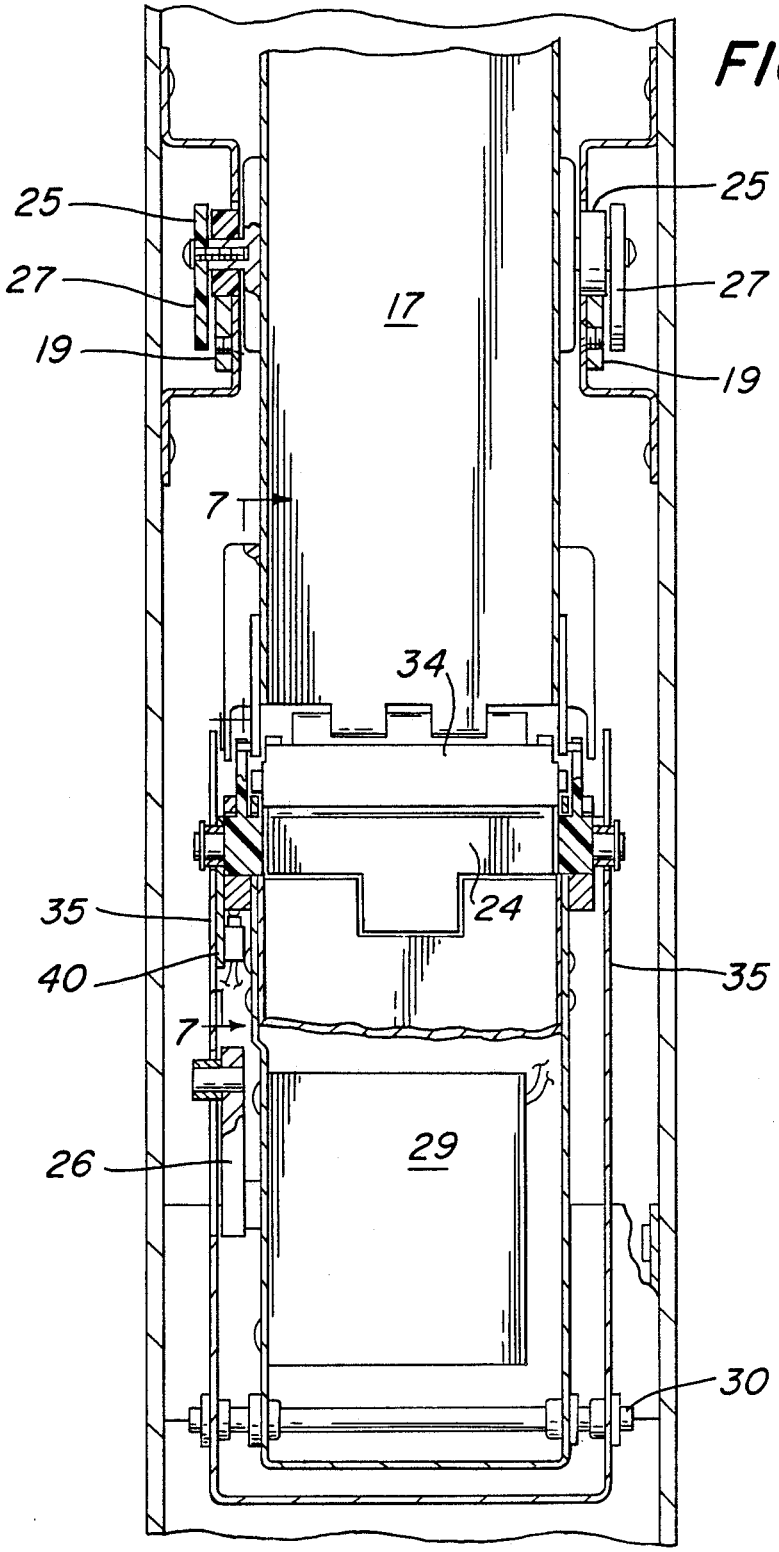
FIG. 9 is a rear sectional view taken from FIG. 2B.

FIG. 9 shows more details of the storage cartridge and feed chute. Because of the weight of the coins in each cartridge 17, the roller and rail support construction is essential to the ease of loading the machine with filled cartridges. Each roller 25 contains an end side bar 27 which centers the cartridge between the supporting side rails.

Figure 10:
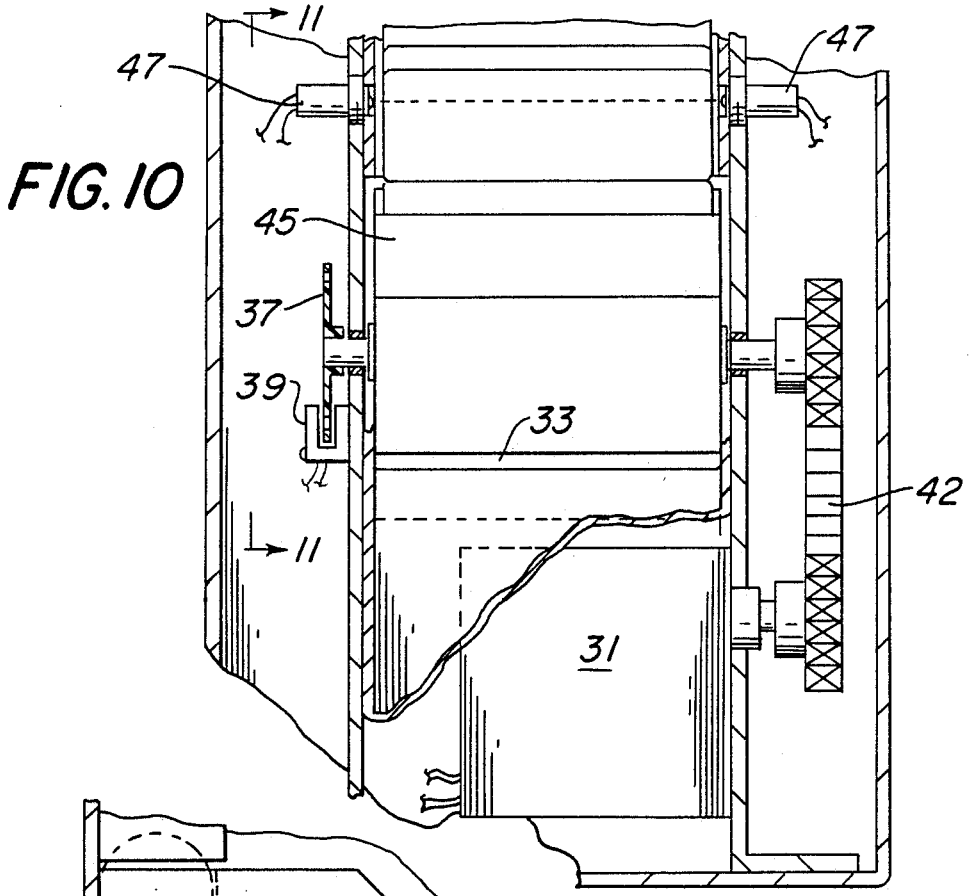
FIG. 10 is a front sectional view taken from FIG. 2B.
Figure 11:
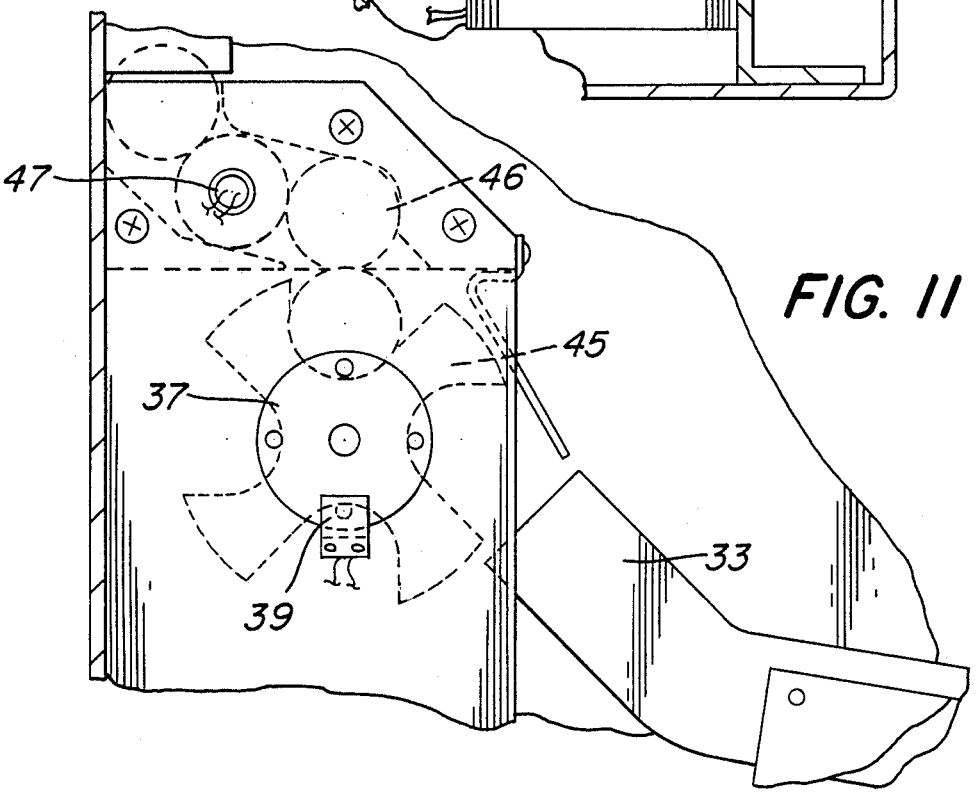
FIG. 11 is a side sectional view taken from FIG. 10.

FIG. 10 shows details of the advancement mechanism for the pinwheel dispenser. The pinwheel is driven by motor means through a belt 42. The axle of the dispenser wheel includes a position indicator 37 and sensor 39 so that the pinwheel is moved sequentially 90 degrees of rotation each time it is actuated. As clearly depicted in FIG. 11, each coin roll 46 is therefore delivered to the dispensing chute 33 each time the pinwheel dispenser 45 is actuated. The feed chute upstream of the pinwheel further includes contact sensing means 47 which indicates when a coin roll 16 does not occupy the feed chute at its location. At this point, only two rolls of coins remain in the machine. The contact sensor is connected to a warning signal, external to the cabinet (not shown), so that stockers will be notified that the machine needs to be re-supplied.

To summarize operation, bills are exchanged for coins as follows. The patron first inserts a bill into the bill acceptance slot, which reads and verifies the legitimacy of the currency. This activates pinwheel 45 which delivers a roll of coins down the dispenser chute 33 to the patron at the front of the machine. As each cartridge is emptied, the dispenser shoe is moved beneath the next full cartridge by rotation of the alignment arm. This process continues until all of the cartridges are emptied and only two coin rolls are left in the dispenser chute just upstream of the dispenser pinwheel. At this point, a sensor located along the feed chute indicates this condition and activates a signal light on the machine cabinet which alerts personnel that restocking of the changer is necessary.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A bill money changer and gambling machines, comprising:

a. a plurality of gambling machines located on a support platform, each machine separated by a narrow space;

b. a bill-activated coin dispenser supported by said platform and located between adjacent gambling machines in said narrow space, said bill money changer being separate from and unattached to said gambling machines;

c. a cabinet enclosing said bill money changer, including a displaceable closure which provides frontal access to the inside of said cabinet and a coin storage area therein;

d. a plurality of separate coin storage cartridges, each cartridge being individually removable from said bill money changer through said displaceable closure; and e. a shoe for receiving coins from each of said cartridges, said shoe being selectively movable between locations beneath each cartridge.

2. The gambling machines of claim 1 further described in that each of said cartridges contains coins in wrapped roll form.

3. The gambling machines of claim 1 wherein said cartridges are held vertically and are stacked front-to-back within said cabinet.

4. The gambling machines of claim 1 wherein said coin cartridges are mounted in said cabinet by way of supporting siderails affixed to the sides of said cabinet.

5. The gambling machines of claim 1 further including guide rollers affixed to the sides of said coin cartridges for riding on supporting siderails.

6. The gambling machines of claim 1 wherein each of said coin cartridges includes a displaceable gate at the bottom, said gate controlling the movement of coins out from said cartridges.

7. The gambling machines of claim 1 further including a trip lever affixed to said shoe, said trip lever engaging a catch-release mechanism which operates to sequentially open the gates of each cartridge as said shoe is moved to a position directly beneath the cartridge.

8. The gambling machines of claim 7 further including motive means for moving said shoe to said locations beneath each cartridge, said motive means being signaled by means which indicate when the cartridge directly above said shoe is empty.

9. The gambling machines of claim 8 further including a pinwheel dispenser which dispenses rolls of coins separately.

10. The gambling machines of claim 9 further including a feed chute for conveying coins by gravity from said shoe to said pinwheel dispenser.

11. The gambling machines of claim 10 including supply sensing means mounted on said feed chute for indicating when the supply of coins within said bill money changer is below a minimum amount.

12. The gambling machines of claim 11 further including electronic bill validation means, said bill validation means signaling the activation of said pinwheel dispenser upon verification and acceptance of a bill.

13. The gambling machines of claim 12 further including external signaling device affixed to the outside of said cabinet, said signal means activated by said supply sensing means.

* * * * *